US006456819B1

(12) United States Patent
Abe et al.

(10) Patent No.: US 6,456,819 B1
(45) Date of Patent: Sep. 24, 2002

(54) IMAGE HEATING APPARATUS

(75) Inventors: Atsuyoshi Abe, Susono; Hitoshi Sato, Kawasaki; Masaaki Takahashi, Asaka; Masahiro Suzuki; Tatsuro Hayakawa, both of Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/628,002

(22) Filed: Jul. 28, 2000

(30) Foreign Application Priority Data

Jul. 30, 1999 (JP) ..... 11-217267

(51) Int. Cl.[7] ..... G03G 15/20
(52) U.S. Cl. ..... 399/329; 219/216
(58) Field of Search ..... 399/320, 329, 399/322; 219/216; 198/837; 474/140

(56) References Cited

U.S. PATENT DOCUMENTS

| | | | | |
|---|---|---|---|---|
| 5,083,168 A | | 1/1992 | Kusaka et al. | |
| 5,162,634 A | * | 11/1992 | Kusaka et al. | 219/216 |
| 5,210,579 A | | 5/1993 | Setoriyama et al. | |
| 5,267,005 A | * | 11/1993 | Yamamoto et al. | 399/329 |
| 5,280,155 A | * | 1/1994 | Ohtsuka et al. | 219/216 |
| 5,525,775 A | | 6/1996 | Setoriyama et al. | 219/216 |
| 5,649,273 A | * | 7/1997 | Shimizu et al. | 399/329 |
| 5,767,484 A | | 6/1998 | Hirabayashi et al. | 219/216 |
| 5,852,763 A | | 12/1998 | Okuda et al. | 399/329 |
| 5,874,710 A | * | 2/1999 | Yoshimoto et al. | 219/216 |
| 5,939,337 A | | 8/1999 | Hatakeyama et al. | 442/6 |

FOREIGN PATENT DOCUMENTS

| | | |
|---|---|---|
| JP | 63-313182 | 12/1988 |
| JP | 02-157878 | 6/1990 |
| JP | 4-44075 | 2/1992 |
| JP | 4-204980 | 7/1992 |
| JP | 05-027619 | 2/1993 |
| JP | 10-198200 | 7/1998 |

* cited by examiner

*Primary Examiner*—Robert Beatty
(74) *Attorney, Agent, or Firm*—Fitzpatrick, Cella, Harper & Scinto

(57) ABSTRACT

The present invention provides an image heating apparatus which has a supporting member, a moving member slidable with the supporting member, and a backup member forming a nip with the supporting member via the moving member, wherein a lubricant is provided between the supporting member and the moving member, and at the nip, an image on a recording material is heated by heat from the moving member, and wherein the supporting member includes a plurality of recess portions in a surface thereof adjacent to the moving member, a width of one of the plurality of recess portions in a moving direction of the moving member is smaller than a width of the nip in that direction, and the plurality of recess portions are arranged in the moving direction of the moving member, and range over the whole of the nip in the moving direction of the moving member.

41 Claims, 14 Drawing Sheets

IMAGE HEATING APPARATUS

BACKGROUND OF THE INVENTION

1. Field of the Invention

This invention relates to an image heating apparatus applied to an image forming apparatus such as a copier or a printer, and particularly to an apparatus in which a moving member slides relative to a supporting member.

2. Related Background Art

For the sake of convenience, an image heating apparatus (fixing apparatus) for heating and fixing a toner image on a recording material which is provided in an image forming apparatus such as a copier or a printer will hereinafter be described as an example.

In an image forming apparatus, an apparatus of the heat roller type has been widely used as a fixing apparatus for heating and fixing an unfixed image (toner image) of image information formed and borne on a recording material (such as a transferring material sheet, an electrofax sheet, electrostatic recording paper, an OHP sheet, printing paper or format paper) in a suitable image forming process means portion such as an electrophotographic process, an electrostatic recording process or a magnetic recording process by a transferring system or a direct system as a permanently secured image on the surface of the recording material.

Recently, from the viewpoints of quick start and energy saving, an apparatus of a film heating type using a heater has been put into practical use. An apparatus of a film heating type utilizing electromagnetic induction heating has also been proposed.

Fixing apparatuses of the film heating type using a heater have been proposed, for example, Japanese Patent Application Laid-Open No. 63-313182, Japanese Patent Application Laid-Open No. 2-157878, Japanese Patent Application Laid-Open No. 4-44075, Japanese Patent Application Laid-Open No. 4-204980, etc.

That is, heat-resisting film (fixing film or fixing belt) is sandwiched between a ceramic heater generally as a heating member and a pressurizing roller as a pressurizing member to thereby form a fixing nip portion, and a recording material on which an unfixed toner image to be fixed is formed and borne is introduced into between the fixing film and the pressurizing roller in the fixing nip portion and is sandwiched and conveyed with the fixing film, whereby in the fixing nip portion, the heat of the ceramic heater is given to the recording material through the fixing film, and the unfixed toner image is heat-and-pressure-fixed on the surface of the recording material by the pressure force of the fixing nip portion.

The fixing apparatus of this film heating type can use members of low heat capacity as the ceramic heater and the fixing film to constitute an apparatus of the on-demand type, and has the advantages that the ceramic heater as a heat source can be electrically energized to thereby generate heat to a predetermined fixing temperature only when the image forming apparatus executes image formation, that the waiting time from the closing of the power source switch of the image forming apparatus till a state in which image formation is executable is short (quick start property), and that the power consumption during standby is greatly small (power saving).

Japanese Patent Application Laid-Open No. 7-114276 proposes a heating apparatus in which an eddy current is created in fixing film itself or an electrically conductive member proximate to the fixing film and heat is generated by Joule heat. This film heating system utilizing electromagnetic induction permits a heat generating region to be proximate to a member to be heated and can therefore achieve the increased efficiency of consumed energy.

In a heating and fixing apparatus of the film heating type, as a method of driving cylindrical or endless fixing film as a rotary member, there is a method of rotating the fixing film brought into pressure contact by a film guide member (film supporting member) for guiding the inner peripheral surface of the fixing film and a pressurizing roller by the rotative driving of the pressurizing roller (a pressurizing roller driving system), or a method of stretching the endless fixing film by a driving roller and a tension roller provided in the endless fixing film, and driving the film.

In the apparatus of the film heating type, as proposed in Japanese Patent Application Laid-Open No. 5-27619, in order to mitigate the influence of rotational torque by the friction between the fixing film and the film guide member, a lubricant such as heat-resisting grease has been interposed between the inner surface of the fixing film and the film guide member to thereby secure the slidability between the fixing film and the film guide member.

As described above, in the heating and fixing apparatus of the film heating type, the inner surface of the fixing film and the film guide member slide in the fixing nip portion and therefore, heat-resisting grease has been applied to the surface of the sliding portion, but when the fixing film is rotated, the lubricant has been swept out from between the fixing film and the surface of the sliding portion by the pressure force for forming the fixing nip portion, and very little of the lubricant on the surface of the sliding portion corresponding to the fixing nip portion has been left.

Therefore, the close contact force between the fixing film and the surface of the sliding portion is increased by duration test when the room temperature or the like is low, and torque rises and thus, such an inconvenience as the fixing jam of recording materials has sometimes occurred due to the loss of synchronism of the driving roller (driving motor) and the slip of the driving roller relative to the fixing film.

SUMMARY OF THE INVENTION

It is an object of the present invention to provide an image heating apparatus improved in the slidability of a moving member and a supporting member.

It is another object of the present invention to provide an image heating apparatus having a supporting member, a moving member slidable with the supporting member, and a backup member forming a nip with the supporting member via the moving member, a lubricant being provided between the supporting member and the moving member, an image on a recording material being heated at the nip by heat from the moving member, the supporting member having a plurality of recess portions in a surface thereof adjacent to the moving member, a width of one of the plurality of recess portions in a moving direction of the moving member being smaller than a width of the nip in that direction, the plurality of recess portions being arranged in the moving direction of the moving member, and ranging over the whole of the nip in the moving direction of the moving member.

It is still another object of the present invention to provide an image heating apparatus having a supporting member, a moving member slidable with the supporting member, and a backup member forming a nip with the supporting member via the moving member, a lubricant being provided between the supporting member and the moving member, an image on a recording material being heated at the nip by the heat from the moving member, the supporting member having a plurality of recess portions in a surface thereof adjacent to the moving member, a width of one of the plurality of recess portions in a moving direction of the moving member being smaller than a width of the nip in that direction, the plurality of recess portions overlapping one another with respect to the moving direction of the moving member over a length of the nip in a direction orthogonal to the moving direction of the moving member.

It is yet still another object of the present invention to provide an image heating apparatus having a supporting member and a moving member slidable with the supporting member, a lubricant being provided between the supporting member and the moving member, an image on a recording material being heated by the heat from the moving member, the supporting member having a groove in a surface thereof adjacent to the moving member, an angle of the groove with respect to a direction orthogonal to the moving direction of the moving member being less than 45°.

It is a further object of the present invention to provide an image heating apparatus having a supporting member and a moving member movable with the supporting member, a lubricant being provided between the supporting member and the moving member, an image on a recording material being heated by heat from the moving member, the supporting member having a first groove and a second groove in a surface thereof adjacent to the moving member, the first groove and the second groove intersecting with each other.

Further objects of the present invention will become apparent from the following description.

DESCRIPTION OF THE PREFERRED EMBODIMENTS

Some embodiments of the present invention will hereinafter be described with reference to the drawings.

Figure 16:
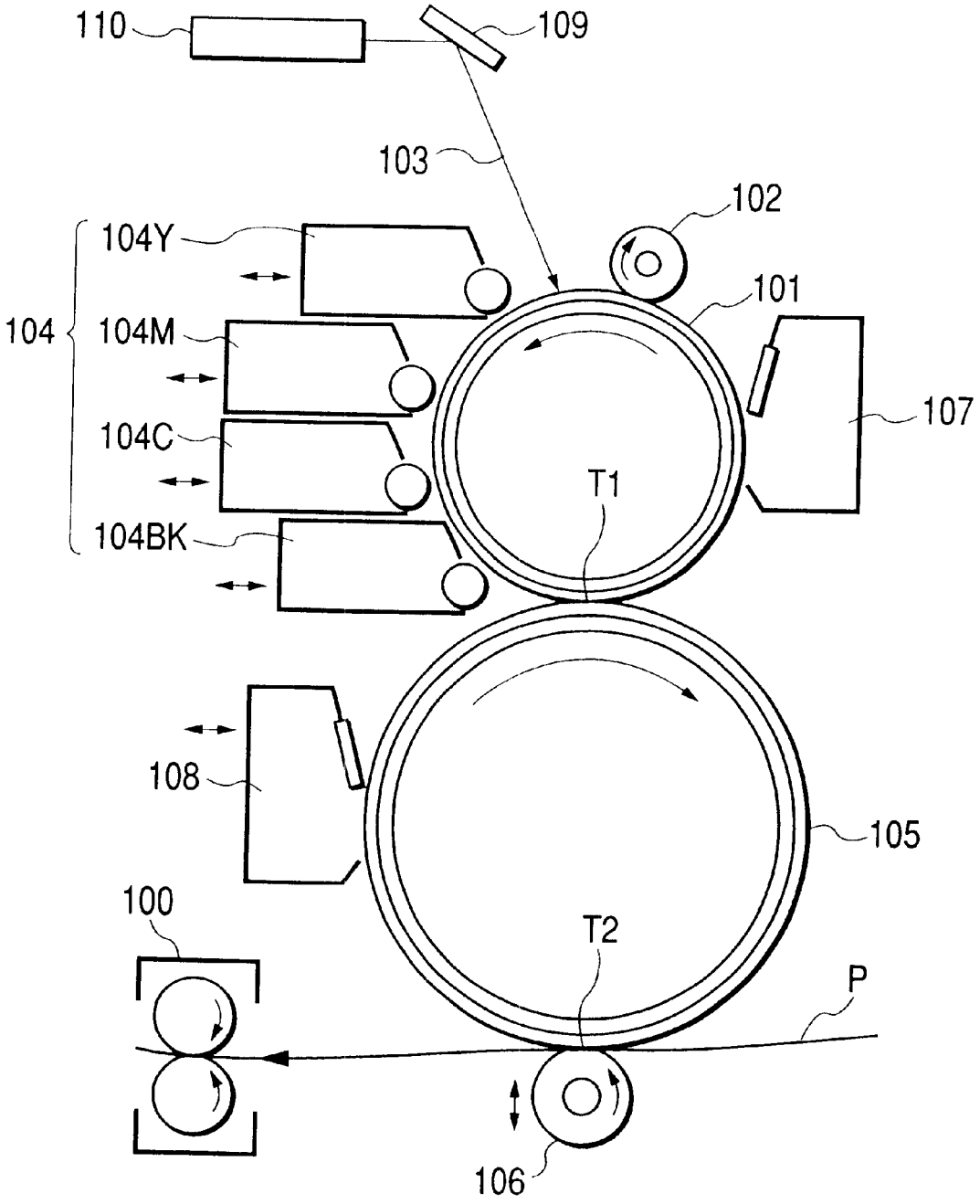
FIG. 16 shows an image forming apparatus to which an image heating apparatus which is an embodiment of the present invention is applied.

FIG. 16 shows an image forming apparatus to which an image heating apparatus which is an embodiment of the present invention is applied, and this image forming apparatus is a color laser printer utilizing the electrophotographic process.

The reference numeral 101 designates a photosensitive drum as an image heating member formed by an organic photosensitive body or an amorphous silicon photosensitive body, and rotatively driven in a counter clockwise direction indicated by arrow at a predetermined process speed (peripheral speed).

The photosensitive drum 101, in its rotating process, is subjected to a uniform charging process of a predetermined polarity and potential by a charging device 102 such as a charging roller.

The charging-processed surface of the photosensitive drum 101 is then subjected to the scanning exposure process of image information by a laser beam 103 outputted from a laser optical box (laser scanner) 110. The laser optical box 110 outputs the laser beam 103 modulated (ON/OFF) correspondingly to the time-serial electrical digital pixel signal of the image information from an image signal producing apparatus such as an image reading apparatus, not shown, and scans and exposes the surface of the photosensitive drum 101. Thereby an electrostatic latent image corresponding to the image information is formed on the surface of the photosensitive drum. The reference numeral 109 denotes a mirror for deflecting the output laser beam from the laser optical box 110 to the exposing position of the photosensitive drum 101.

In the case of full color image formation, the scanning exposure and latent image formation with respect to a first color resolved component image, e.g. a yellow component image, of a desired full color image is done, and the latent image is developed as a yellow toner image by the operation of the yellow developing device 104Y of a four-color developing apparatus 104. The yellow toner image is transferred to the surface of an intermediate transferring drum 105 in a primary transferring portion T1 which is the contact portion (or the proximate portion) between the photosensitive drum 101 and the intermediate transferring drum 105. After the transfer of the toner image to the surface of the intermediate transferring drum 105, the surface of the photosensitive drum 101 is cleaned by a cleaner 107 so as to remove any adhering residual thereon such as untransferred toner.

The process cycle of charging, scanning exposure, development, primary transfer and cleaning as described above is sequentially executed for the respective color resolved component images of the desired full color image, i.e., a second color resolved component image (e.g. a magenta component image, a magenta developing device 104M being operated), a third color resolved component image (e.g. a cyan component image, a cyan developing device 104C being operated), and a fourth color resolved component image (e.g. a black component image, a black developing device 104BK being operated), whereby toner images of four colors, i.e., a yellow toner image, a magenta toner image, a cyan toner image and a black toner image, are successively superposed and transferred onto the surface of the intermediate transferring drum 105, and a color toner image corresponding to the desired full color image is formed.

The intermediate transferring drum 105 comprises a metallic drum, and an elastic layer of medium resistance and a surface layer of high resistance provided thereon, and is rotatively driven in a clockwise direction indicated by arrow at the same peripheral speed as that of the photosensitive drum 101 while being in contact with or in proximity to the photosensitive drum 101, and bias potential is given to the metallic drum of the intermediate transferring drum 105, and by the potential difference from the photosensitive drum 101, the toner image on the photosensitive drum 101 is transferred to the surface of the intermediate transferring drum 105.

The color toner image formed on the surface of the intermediate transferring drum 105 is transferred to the surface of a recording material P in a secondary transferring portion T2 which is the contact nip portion between the intermediate transferring drum 105 and a transferring roller 106, the recording material P being fed from a sheet feeding portion, not shown, to the secondary transferring portion T2 at predetermined timing. The transferring roller 106 collectively transfers the composite color toner image from the surface of the intermediate transferring drum 105 to the recording material P by being supplied with charges of the opposite polarity to the toners from the back of the recording material P.

The recording material P passed through the secondary transferring portion T2 is separated from the surface of the intermediate transferring drum 105 and is introduced into a fixing apparatus (image heating apparatus) 100, and is subjected to the heating and fixing process of the unfixed toner image, and is discharged onto a sheet discharge tray, not shown, outside the apparatus. The fixing apparatus 100 will be described later.

After the transfer of the color toner image to the recording material P, the intermediate transferring drum 105 is cleaned by a cleaner 108 so as to remove adhering residuals such as untransferred toners and paper powder. This cleaner 108 is normally held in non-contact with the intermediate transferring drum 105, and is held in contact with the intermediate transferring drum 105 in the secondary transfer executing process of the color toner image from the intermediate transferring drum 105 to the recording material P.

The transferring roller 106 also is normally held in non-contact with the intermediate transferring drum 105, and is held in contact with the intermediate transferring drum 105 with the recording material P therebetween in the secondary transfer executing process of the color toner image from the intermediate transferring drum 105 to the recording material P.

The image forming apparatus of the present embodiment can also execute the printing mode of monochromatic images such as black and white images. It can also execute the both-surface image printing mode or the multiplex image printing mode.

In the case of the both-surface image printing mode, a recording material P with an image printed on a first surface thereof which has left the fixing apparatus 100 is reversed through a re-circulation conveying mechanism, not shown, and is again fed to the secondary transferring portion T2, where it is subjected to the toner image transfer to its second surface, and is again introduced into the fixing apparatus 100 and is subjected to the fixing process of the toner image for a second surface thereof, whereby a both-surface image print is outputted.

In the case of the multiplex image printing mode, the recording material P with an image printed on the first surface thereof which has left the fixing apparatus 100 is not reversed through the recirculation conveying mechanism, not shown, and is again fed into the secondary transferring portion T2, where it is subjected to the second toner image transfer on the surface on which the first image printing has been done, and is again introduced into the fixing apparatus 100, where it is subjected to the second fixing process of the toner image, whereby a multiplex image print is outputted.

An image heating apparatus which is an embodiment of the present invention will now be described in detail.

The heating apparatus in the present embodiment is an image heating and fixing apparatus of the pressurizing roller driving type or the electromagnetic induction heating type using cylindrical fixing film (fixing belt) of an electromagnetic induction heat generating property as a heating member.

(1) General Schematic Construction of the Apparatus

Figure 1:
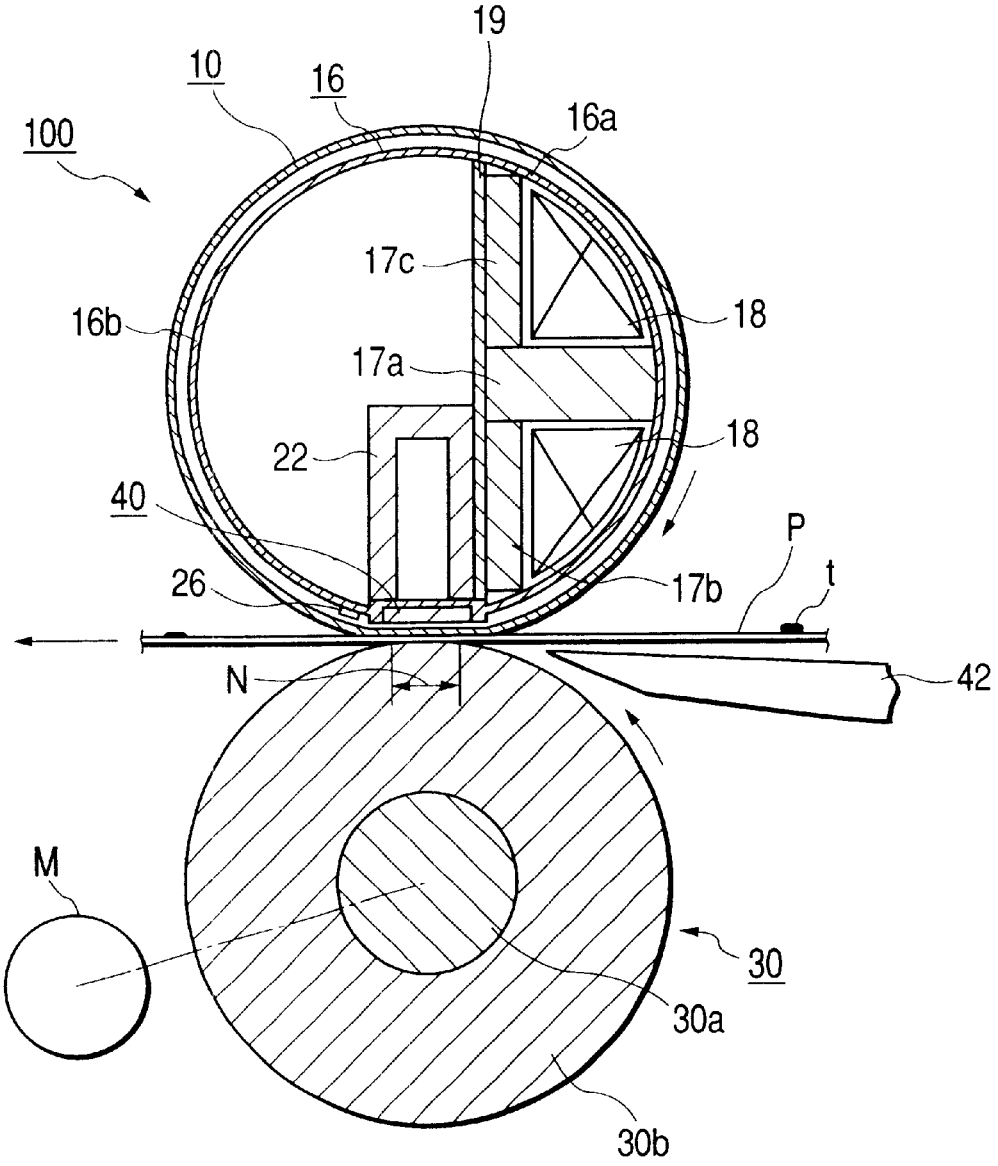
FIG. 1 is a cross-sectional view of an image heating apparatus which is an embodiment of the present invention.
Figure 2:
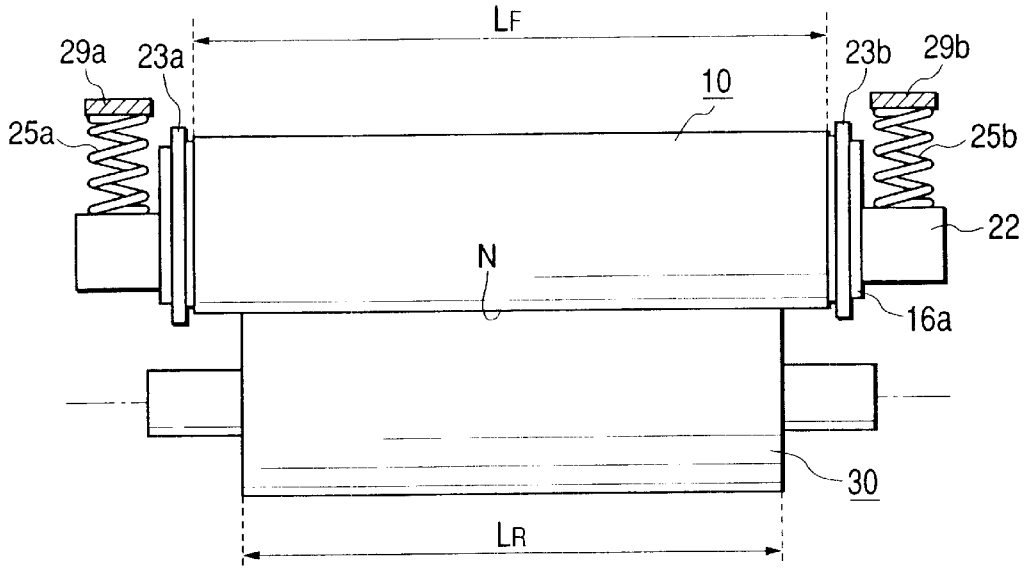
FIG. 2 is a front view of the image heating apparatus.
Figure 3:
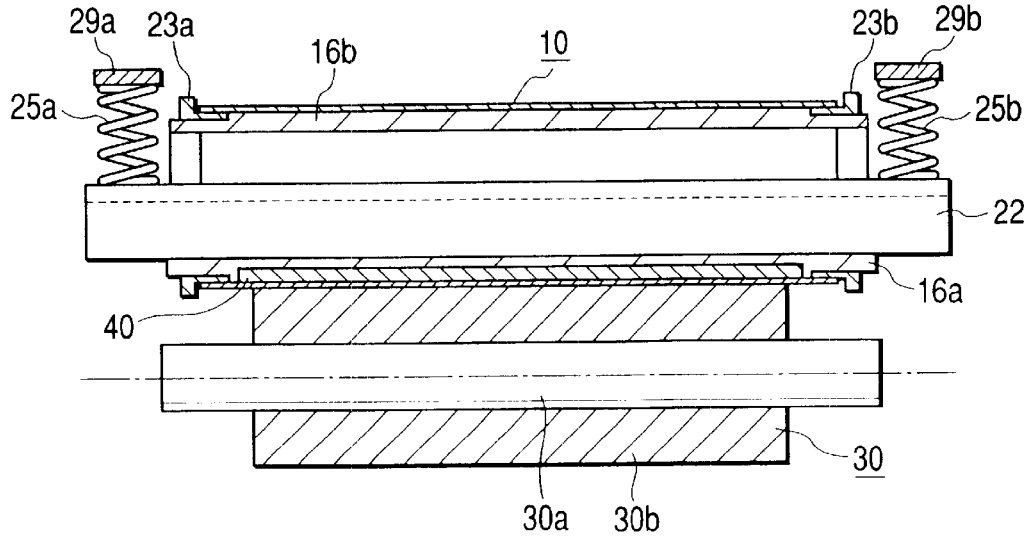
FIG. 3 is a front cross-sectional view of the image heating apparatus.

FIG. 1 is a cross-sectional model view of the essential portions of the image heating and fixing apparatus 100 as a heating apparatus in the present embodiment, FIG. 2 is a front model view of the essential portions, and FIG. 3 is a longitudinal cross-sectional model view of the essential portions.

This apparatus 100, when broadly divided, comprises a cylindrical film guide member 16 as a first member, cylindrical fixing film 10 of an electromagnetic induction heat generating property which is a moving member as a second member loosely fitted to this film guide member 16, and a pressurizing roller 30 as a third member which is a backup member formed with a nip portion N with the fixing film 10 interposed between itself and the film guide member 16.

The cylindrical film guide member (film supporting member) 16 is formed as a cylindrical body by a pair of right and left trough type halves 16*a* and 16*b* of substantially semi-arcuate transverse cross-section being combined together with their opening sides facing each other. Magnetic cores 17*a*, 17*b* and 17*c* and an excitation coil 18 as magnetic field producing means are disposed and held inside the right half 16*a* of the film guide member 16.

A pressurizing roller 30 is comprised of a mandrel 30*a*, and a heat-resisting elastic material layer 30*b* of silicone rubber, fluorine rubber, fluorine resin or the like formed into a roller shape around the mandrel concentrically and integrally therewith and covering the mandrel, and the opposite end portions of the mandrel 30*a* are rotatably held by bearings between the chassis side metal plates, not shown, of the apparatus.

The film guide member 16 having the fixing film 10 fitted thereon is disposed on the upper side of the pressurizing roller 30, and pressurizing springs 25*a* and 25 are compressedly provided between the opposite end portions of a pressurizing rigid stay inserted into and disposed in the film guide member 16 and spring receiving members 29*a*, 29*b* on the apparatus chassis side to thereby make a depressing force act on the pressurizing rigid stay 22. Thereby, the lower surface of the film guide member 16 and the upper surface of the pressurizing roller 30 are brought into pressure contact with each other with the fixing film 10 interposed therebetween, and a fixing nip portion N of a predetermined width is formed.

The pressurizing roller 30 is rotatively driven in a counterclockwise direction indicated by arrow by driving means M (FIG. 1). By the rotative driving of this pressurizing roller 30, a rotational force acts on the fixing film 10 in the fixing nip portion N by the frictional force between the pressurizing roller 30 and the outer surface of the fixing film 10, and the inner peripheral surface of the fixing film 10 comes into close contact with the lower surface of the film guide member 16 in the fixing nip portion N and comes to rotate around the film guide member 16 in a clockwise direction indicated by arrow at a peripheral speed substantially corresponding to the peripheral speed of the pressurizing roller 30 while sliding (the pressurizing roller driving type).

In order to reduce the mutual sliding frictional force between the lower surface of the film guide member 16 and the inner surface of the fixing film 10 in the fixing nip portion N, a sliding member 40 which is a supporting member of low frictional property is disposed on the surface portion of the lower surface of the film guide member 16 corresponding to the fixing nip portion N. This sliding member 40 will be described later in detail in item 4 mentioned below.

Figure 4:
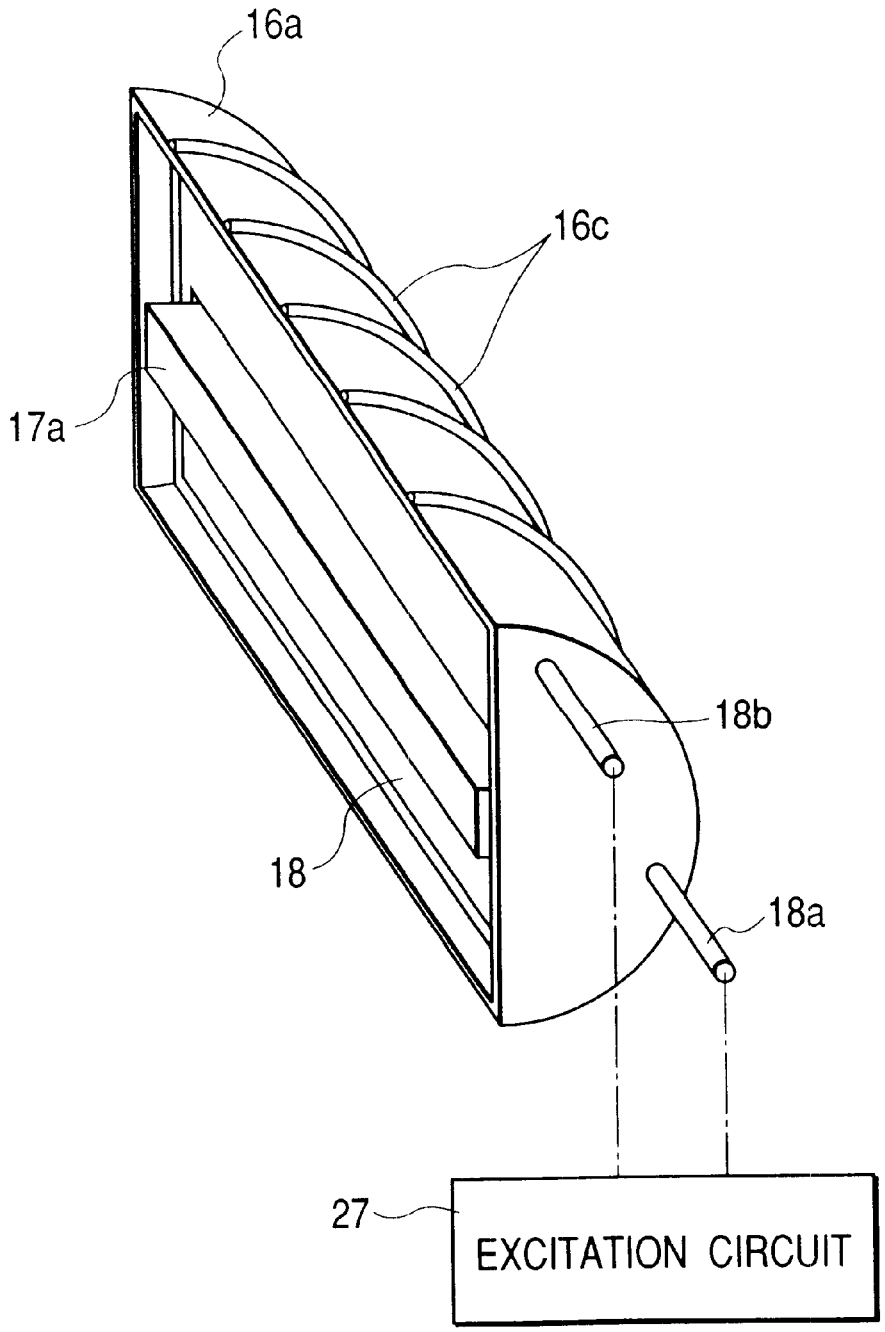
FIG. 4 is a perspective view of a film guide member (a half).

Also, as shown in FIG. 4, convex rib portions 16*c* are formed on the peripheral surface of the right film guide member half 16*a* at predetermined intervals in the lengthwise direction thereof to thereby reduce the contact sliding resistance with respect to the peripheral surface between the film guide member half 16*a* and the inner surface of the fixing film 10 and reduce the rotational load of the fixing film 10. Such convex rib portions 16*c* can also be likewise formed on the left film guide member half 16*b*.

The reference characters 23*a* and 23*b* denote flange members fitted to and disposed on the end portions on this side and the inner part side of the cylindrical film guide member 16, and these flange members receive the end portions of the fixing film 10 during the rotation thereof and serve to regulate the movement of the fixing film 10 along the length of the film guide member 16. The flange members 23*a* and 23*b* may be made into a construction in which they are rotated following the rotation of the fixing film 10.

Thus, in a state in which the pressurizing roller 30 is rotatively driven and along therewith, the fixing roller 10 is rotated and the electromagnetic induction heat generation of the fixing film 10 as a heating member is done by the action of a magnetic field produced by the power supply from the excitation circuit 27 (FIG. 4) to the excitation coil 18 and the fixing nip portion N has risen to a predetermined temperature is controlled thereto, the recording material P on which the unfixed toner image t is formed and is conveyed from an image forming means portion, not shown, is introduced with the image bearing surface thereof facing upwardly between the fixing film 10 and the pressurizing roller 30 of the fixing nip portion N, that is, with the image bearing surface opposed to the surface of the fixing film, and in the fixing nip portion N, the image bearing surface comes into close contact with the outer surface of the fixing film 10 and the recording material is sandwiched and conveyed in the fixing nip portion N with the fixing film 10.

In the process wherein the recording material P is sandwiched and conveyed in this fixing nip portion N with the fixing film 10, the unfixed toner image t on the recording material P is heated and fixed by the electromagnetic induction generated heat of the fixing film 10. At this time, the toner image t on the recording material P is preliminarily heated on an entrance guide 42. When it passes through the fixing nip portion N, the recording material P is separated from the outer surface of the rotating fixing film 10 and is discharged. The heated and fixed toner image t on the recording material P is cooled and becomes a permanently secured image after it has passed through the fixing nip portion N.

In the image heating and fixing apparatus 100 in the present embodiment, a toner containing a low softening substance is used as the toner t and therefore, an oil applying mechanism for preventing offset is not provided in the fixing apparatus, but use is made of a toner not containing the low softening substance, the oil applying mechanism may be provided. Also, when use is made of a toner containing the low softening substance, the application of oil and cooling and separation may be done.

(2) Magnetic Field Producing Means

The magnetic cores 17*a*, 17*b* and 17*c* are members of high magnetic permeability, and may preferably be formed of a material such as ferrite or permaloy used in the core of a transformer, and more preferably use may be made of ferrite which is small in loss even at 100 kHz or higher.

As regards the excitation coil 18, a plurality of thin copper wires each insulation-covered and bundled (a bundle wire) are used as lead wires (electric wires) constituting the coil (winding), and these are wound a plurality of times to thereby form the excitation coil. In the present embodiment, the bundle wire is wound by 10 turns to thereby form the excitation coil 18.

The insulating cover may preferably be a cover having heat resistance with the heat conduction of the fixing film 10 by the heat generation thereof taken into account. For example, a cover of amide imide, polyimide or the like may preferably be used. In the present embodiment, a cover of polyimide is used and the heat resisting temperature thereof is 220° C.

Pressure may be applied from outside to the excitation coil 18 to thereby improve the degree of assembly thereof.

An insulating member 19 is disposed between the magnetic field producing means 17*a*, 17*b*, 17*c*, 18 and the pressurizing rigid stay 22. A material excellent in insulating property and good in heat resistance is preferable as the material of this insulating member 19. For example, phenol resin, fluorine resin (PFA resin, PTFE resin, FEP resin), polyimide resin, polyamide resin, polyamide imide resin, PEEK resin, PES resin, PPS resin, LCP resin or the like may preferably be selected.

An excitation circuit 27 is connected to the power supplying portions 18*a* and 18*b* of the excitation coil 18. This excitation circuit 27 is designed to be capable of producing a high frequency of 20 kHz to 500 kHz by a switching power source.

The excitation coil 18 produces an alternating magnetic flux by an alternating current (high frequency current) supplied from the excitation circuit 27.

Figure 5:
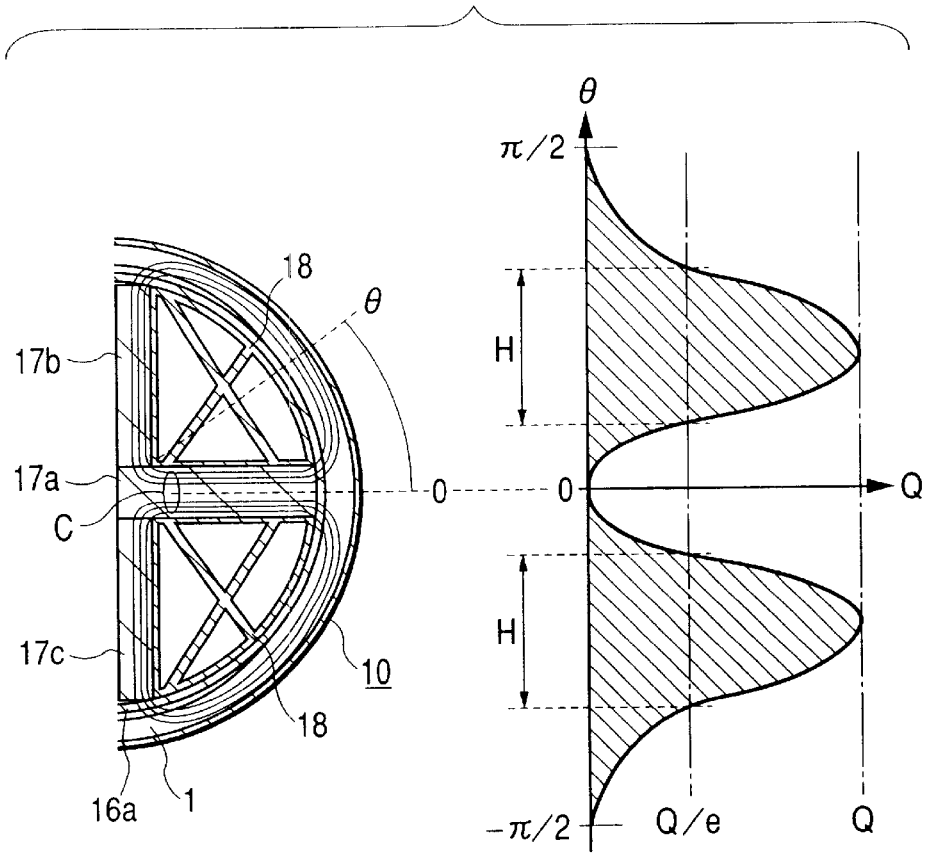
FIG. 5 shows the relation between magnetic field producing means and the amount of generated heat.

FIG. 5 typically represents the manner in which the alternating magnetic flux is produced. A magnetic flux C represents a part of the produced alternating magnetic flux. The alternating magnetic flux C directed to the magnetic cores 17*a*, 17*b* and 17*c* produces an eddy current in the electromagnetic induction heat generating layer 1 of the fixing film 10 which will be described later between the magnetic core 17*a* and the magnetic core 17*b* and between the magnetic core 17*a* and the magnetic core 17*c*. This eddy current produces Joule heat (eddy current loss) in the electromagnetic induction heat generating layer 1 by the specific resistance of the electromagnetic induction heat generating layer 1. The amount of generated heat Q here is determined by the density of a magnetic flux passing through the electromagnetic induction heat generating layer and exhibits a distribution as shown in the graph of FIG. 5.

In the graph of FIG. 5, the axis of ordinates shows a position in the circumferential direction in the fixing film 10 represented by an angle θ in which the center of the magnetic core 17*a* is 0, and the axis of abscissas shows the amount of generated heat Q in the electromagnetic induction heat generating layer 1 of the fixing film 10. Here, the heat generating area H is defined as an area in which, when the maximum amount of generated heat is defined as Q, the amount of generated heat is Q/e or greater. This is an area in which the amount of generated heat necessary for fixing is obtained.

The temperature of the fixing nip portion N is controlled so that a predetermined temperature may be maintained by the supply of an electric current to the excitation coil 18 being controlled by a temperature controlling system including temperature detecting means 26 (FIG. 1). The temperature detecting means 26 is a temperature sensor such as a thermistor for detecting the temperature of the fixing film 10, and in the present embodiment, design is made such that the temperature of the fixing nip portion N is controlled on the basis of the temperature information of the fixing film 10 measured by the temperature sensor 26.

(3) Fixing Film 10

Figure 6:
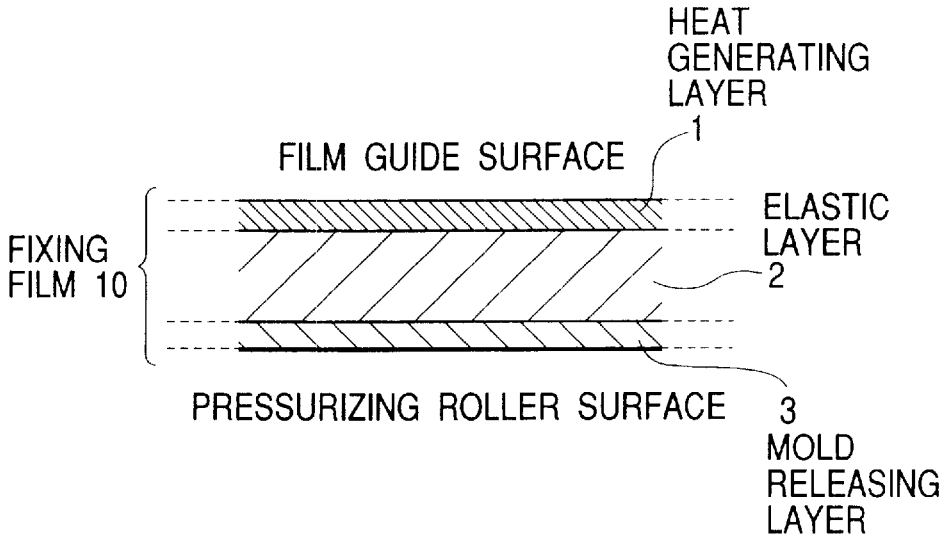
FIG. 6 shows the layer construction of film.

FIG. 6 is a model view of the layer construction of the fixing film 10 in the present embodiment.

The fixing film 10 in the present embodiment is of composite structure comprising a heat generating layer 1 formed of metallic film or the like which is the base layer of the fixing film of an electromagnetic induction heat generating property, an elastic layer 2 laminated on the outer surface thereof, and a mold releasing layer 3 further laminated on the outer surface thereof.

For the adhesive securing between the heat generating layer 1 and the elastic layer 2 and between the elastic layer 2 and the mold releasing layer 3, a primer layer may be provided between the respective layers.

In the fixing film 10 which is of a substantially cylindrical shape, the heat generating layer 1 is the inner surface side and the mold releasing layer 3 is the outer surface side. As previously described, the alternating magnetic flux acts on the heat generating layer 1, whereby an eddy current is produced in the heat generating layer 1 and the heat generating layer 1 generates heat. The heat induction-generated in this layer heats the whole of the fixing film 10, and heats the recording material P passed to the fixing nip portion N through the elastic layer 2 and the mold releasing layer 3, whereby the heating and fixing of the toner t image are done.

a. Heat Generating Layer 1

For the heat generating layer 1, use may preferably be made of a ferromagnetic metal such as nickel, iron, ferromagnetic SUS or a nickel-cobalt alloy.

A non-magnetic metal may also be used, but more preferably, use may be made of a metal having a good magnetic flux absorbing property such as nickel, iron, magnetic stainless steel or a cobalt-nickel alloy.

The thickness of the heat generating layer 1 may preferably be greater than the depth of the epidermis represented by the following expression and equal to or less than 200 $\mu$m. The depth $\sigma$[m] of the epidermis is represented as follows by the frequency f [Hz] of the excitation circuit, magnetic permeability $\mu$ and specific resistance $\rho$ [$\Omega$m].

$$\sigma=503\times(\rho/f\mu)^{1/2}$$

Figure 8:
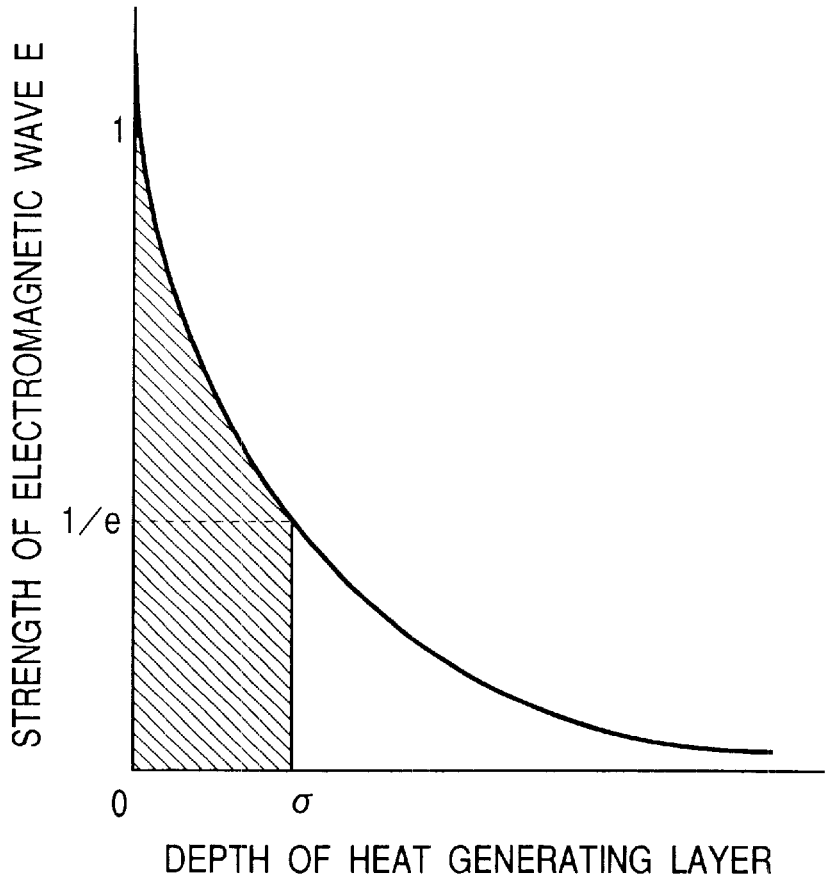
FIG. 8 is a graph showing the relation between the depth of a heat generating layer and the strength of an electromagnetic wave.

This shows the depth of the absorption of an electromagnetic wave used in electromagnetic induction, and shows that the strength of the electromagnetic wave is 1/e or less in portions deeper than this. Conversely speaking, almost all energy is absorbed to this depth (FIG. 8).

The thickness of the heat generating layer 1 may preferably be 1 to 100 $\mu$m. If the thickness of the heat generating layer is smaller than 1 $\mu$m, almost all electromagnetic energy cannot be absorbed and therefore the efficiency becomes bad. Also, if the thickness of the heat generating layer 1 exceeds 100 $\mu$m, rigidity becomes too high, and the bending property becomes bad and it is not realistic to use the fixing film as a rotary body. Accordingly, the thickness of the heat generating layer 1 may preferably be 1 to 100 $\mu$m.

b. Elastic Layer 2

The elastic layer 2 is formed of a material of good heat resistance and heat conductivity such as silicone rubber, fluorine rubber or fluorosilicone rubber.

The thickness of the elastic layer 2 may preferably be 10 to 500 $\mu$m. This thickness of the elastic layer 2 is a thickness necessary to ensure the quality of fixed images.

When a color image is to be printed, a solid image is formed on the recording material P over a large area particularly in the case of a photographic image. In this case, if the heating surface (mold releasing layer 3) cannot follow the unevenness of the recording material P or the unevenness of the toner layer t, heating irregularity will occur, and luster irregularity will occur in a portion wherein the amount of heat transfer is great and a portion wherein the amount of heat transfer is small. The portion wherein the amount of heat transfer is great is high in the degree of luster, and the portion wherein the amount of heat transfer is small is low in the degree of luster.

If the thickness of the elastic layer 2 is 10 $\mu$m or less, it cannot follow the unevenness of the recording material or the toner layer and the luster irregularity of images will occur. Also, if the thickness of the elastic layer 2 is 1000 $\mu$m or greater, the heat resistance of the elastic layer will become great and it will become difficult to realize quick start. More preferably, the thickness of the elastic layer 2 may be 50 to 500 $\mu$m.

If the elastic layer 2 is too high in hardness, it cannot follow the unevenness of the recording material P or the toner layer t and the luster irregularity of images will occur. So, the hardness of the elastic layer 2 may preferably be 60° (JIS-A: JIS-K A type test machine) or less, and more preferably be 45° or less.

The heat conductivity $\lambda$ of the elastic layer 2 may preferably be $6\times10^{-4}$ to $2\times10^{-3}$ [cal/cm·sec·deg]. When the heat conductivity $\lambda$ is smaller than $6\times10^{-4}$ [cal/cm·sec·deg] ($(6\times10^{-4})\times10^{-3}\times10^{2}\times3600\times1.163 \cong 0.25$ [W/m·K]), heat resistance becomes great and the temperature rise in the surface layer (mold releasing layer 3) of the fixing film 10 becomes delayed. When the heat conductivity $\lambda$ is greater than $2\times10^{-3}$ [cal/cm·sec·deg] ($(2\times10^{-3})\times3.6\times10^{2}\times1.163\cong0.84$ [W/m·K]), the hardness becomes two high or compression set is aggravated. Consequently, the heat conductivity $\lambda$ may preferably be $6\times10^{-4}$ to $2\times10^{-3}$ [cal/cm·sec·deg]. More preferably, it may be $8\times10^{-4}$ to $1.5\times10^{-3}$ [cal/cm·sec·deg] (0.33 to 0.63 [W/m·K]).

c. Mold Releasing Layer 3

For the mold releasing layer (releasing layer) 3, a material good in mold releasing property and heat resistance such as fluorine resin (PFA, PTFE or FEP), silicone resin, fluorosilicone rubber, fluorine rubber or silicone rubber can be selected.

The thickness of the mold releasing layer 3 may preferably be 1 to 100 $\mu$m. If the thickness of the mold releasing layer 3 is smaller than 1 $\mu$m, there will arise the problem that a portion bad in mold releasing property is formed by the application irregularity of applied film or durability is insufficient. Also, if the thickness of the mold releasing layer exceeds 100 $\mu$m, there will arise the problem that heat conductivity is aggravated, and particularly in the case of a mold releasing layer of a resin material, hardness will become too high and the effect of the elastic layer 2 will become null.

d. Insulating Layer 4

Figure 7:
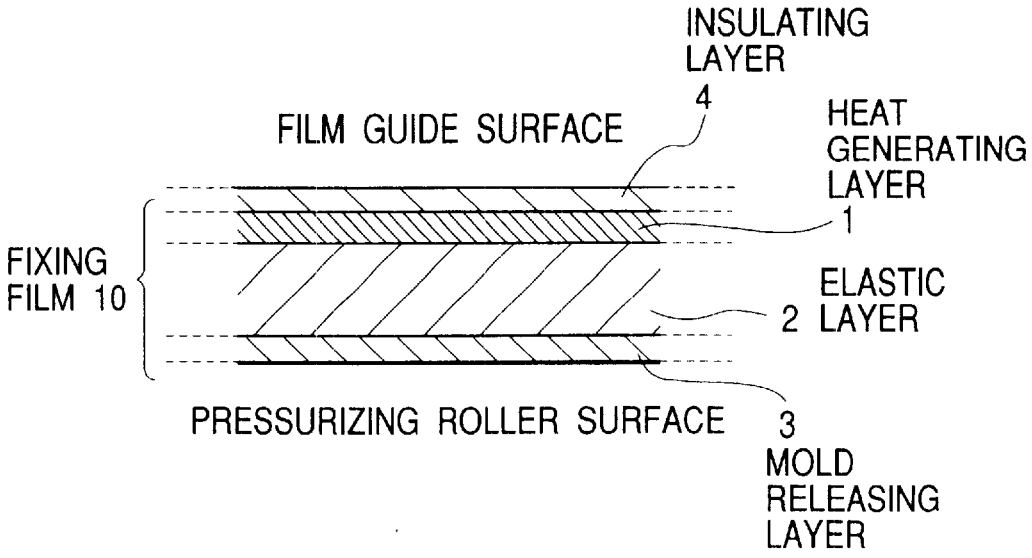
FIG. 7 shows the layer construction of other film.

Also, as shown in FIG. 7, in the construction of the fixing film 10, an insulating layer 4 may be provided on the free surface side of the heat generating layer 1 (the surface side of the heat generating layer 1 which is opposite to the elastic layer 2 side).

As the insulating layer 4, heat resisting resin such as fluorine resin (PFA resin, PTFE resin or FEP resin), polyimide resin, polyamide resin, polyamide imide resin, PEEK resin, PES resin or PPS resin is preferable.

Also, the thickness of the insulating layer 4 may preferably be 10 to 1000 μm. If the thickness of the insulating layer 4 is smaller than 10 μm, the insulating effect will not be obtained and durability will be insufficient. On the other hand, if the thickness of the insulating layer 4 exceeds 1000 μm, the distance of the heat generating layer 1 from the magnetic cores 17 and the excitation coil 18 will become great, and the magnetic flux will not be sufficiently absorbed into the heat generating layer 1.

The insulating layer 4 can insulate so that the heat generated in the heat generating layer 1 may not travel toward the inside of the fixing film 10 and therefore, as compared with a case where the insulating layer 4 is absent, the heat supplying efficiency to the recording material P side becomes good. Consequently, the consumption of electric power can be suppressed.

(4) Sliding Member 40

As previously described, in order to reduce the sliding frictional force between the lower surface of the film guide member 16 and the inner surface of the fixing film 10 in the fixing nip portion N, a sliding member 40 of a heat resisting property and low friction property formed of e.g. polyimide resin (PI), glass, alumina or alumina coated with glass is disposed on the surface of the fixing film sliding portion corresponding to the fixing nip portion N on the lower surface of the film guide member 16.

This sliding member 40 is a supporting member for supporting the film, and is a band plate-shaped or tape-shaped member having a length and a width corresponding to at least the length and width of the fixing nip portion N, and in the present embodiment, it is positioned and held by being fitted in a fitting groove portion provided along the length of the lower surface of the film guide member 16. Further, it may preferably be fixed by a heat-resisting adhesive agent. In the present embodiment, the width of the sliding member is greater than the width of the nip, and the length of the sliding member is greater than the length of the nip.

Figure 9A:
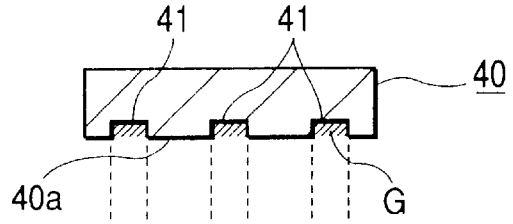
FIGS. 9A and 9B show a sliding member.
Figure 9B:
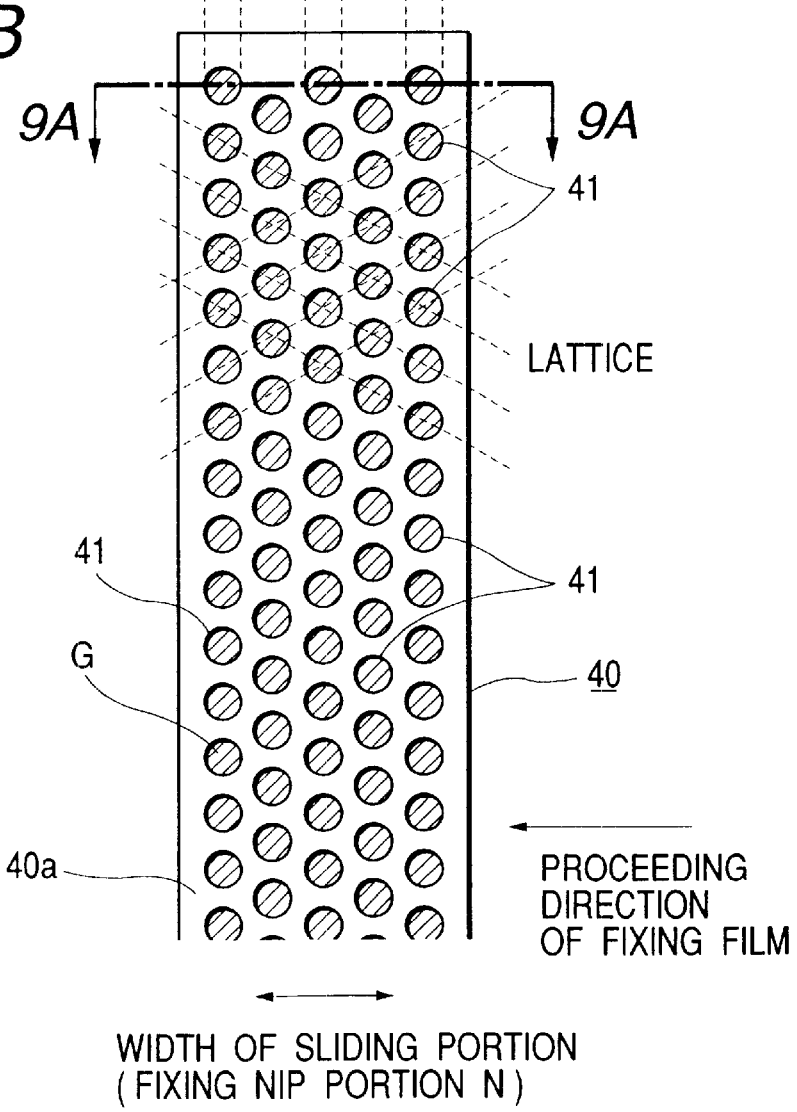

The free surface (lower surface) of the sliding member 40 which is the surface of the fixing film sliding portion in the fixing nip portion N of the film guide member 16 is of a construction provided with a plurality of independent recess portions 41, as shown in the model view of FIGS. 9A and 9B, in order to further reduce the sliding frictional resistance between itself and the inner surface of the fixing film 10. FIG. 9A is an enlarged transverse cross-sectional model view of the sliding member 40, and FIG. 9B is a plan front model view of the lower surface formed with the recess portions 41.

The width of each recess portion in the moving direction of the film is smaller than the width of the nip in that direction and each of the recess portions is independent, and at least some of the recess portions are arranged in the moving direction of the film, and range over the full with of the nip in the moving direction of the film. Also, the width of each recess portion in a direction orthogonal to the moving direction of the film is smaller than the width of the nip in that direction, and the recess portions are independently arranged in that direction.

In the present embodiment, each recess portion is a circular concave portion having a diameter (ϕ) of 0.5 mm and a depth of 0.1 mm. The recess portions 41 may preferably be formed in the lower surface of the sliding member 40 at intervals set along the lengthwise direction thereof so that the diameter may be 0.1 to 3 mm, the depth may be 0.01 mm or greater and the total area of the recess portions corresponding to the nip may be 20 to 60% of the area of the surface of the sliding portion corresponding to the fixing nip portion N. The pitch between the centers of the recess portions 41 may be arbitrary, but it is preferable that the recess portions be disposed so that the recess portions 41 may exist without fail relative to the direction of progress of the fixing film 10.

That is, the plurality of recess portions overlap one another with respect to the moving direction of the film over the length of the nip in a direction orthogonal to the moving direction of the film.

In the present invention, as a method of calculating the area of the recess portions, the projection area at a position of 1½ of the depth of the recess portions is defined as the area of the recess portions.

Figure 10:
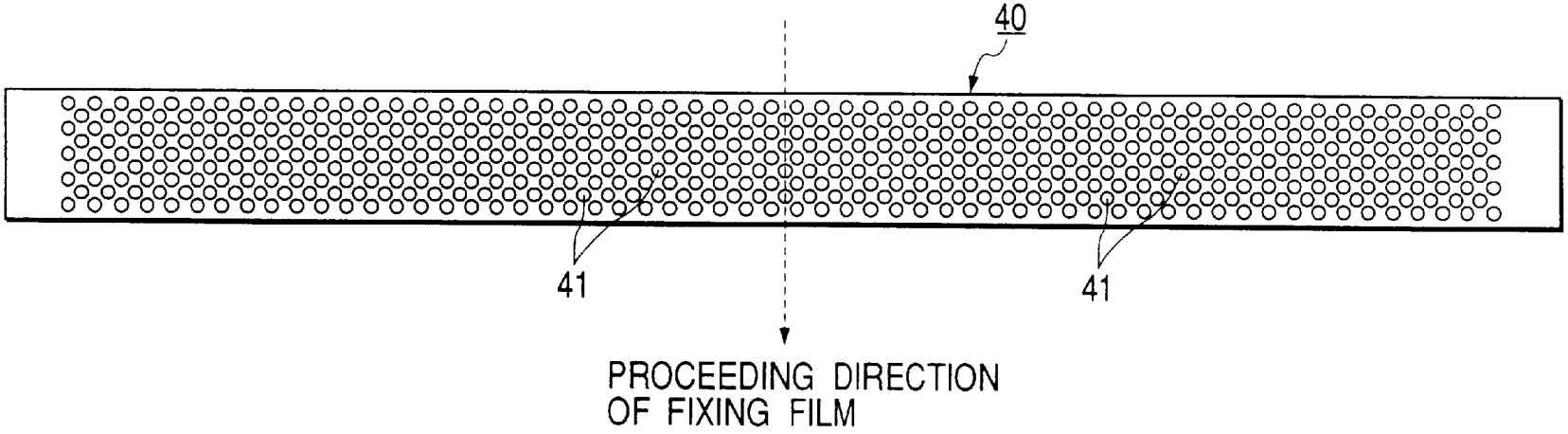
FIG. 10 shows the whole of the sliding member.

In the fixing nip portion N, the arrangement of the recess portions 41 relative to the length may preferably be such that the recess portions exist without fail in the width of the nip. It is preferable that as in the examples shown, for example, in FIGS. 9B and 10, the recess portions be disposed on lattice points.

As a comparative example, when a recess portion continuous in the lengthwise direction is provided, a pressing force linearly concentrate in the edge portion of the recess portion and causes the rise of torque, and this is not very preferable. As in the present example, the recess portions are disposed on lattice points, whereby the pressurizing force to the edge portions of the recess portions is dispersed, and without the rise of torque, the area of contact between the fixing film 10 and the sliding member 40 can be decreased. Consequently, the close contact force between the fixing film 10 and the sliding member 40 can be decreased. Therefore, as compared with a construction lacking the recess portions 41, the torque at the start of rotation from a time when room temperature or the like is low can be restrained to a low level.

Figure 11A:
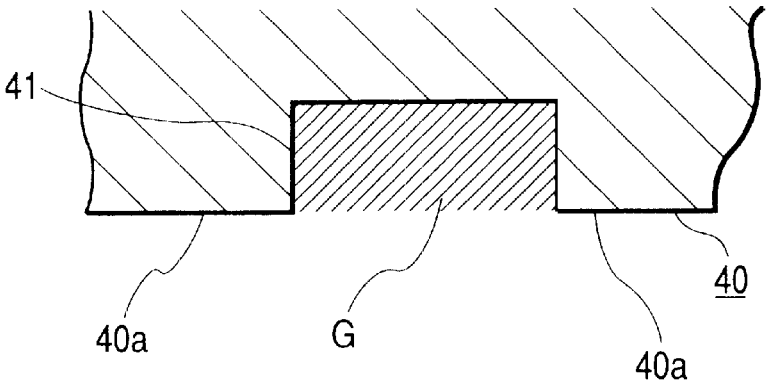
FIGS. 11A and 11B show a recess portion in the sliding member.
Figure 11B:
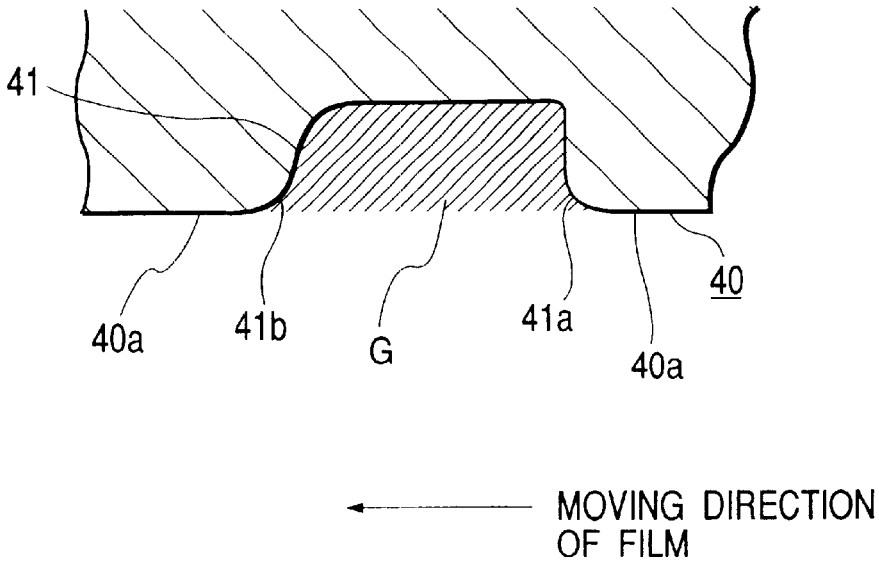

FIG. 11A shows a form of the connecting portion between the flat portions 40*a* of the sliding member 40 and the recess portion 41. As shown in FIG. 11B, the flat portions 40*a* of the sliding member 40 and the recess portion 41 may more preferably be connected together by curved surfaces 41*a* and 41*b*. By connecting them together by the curved surfaces, a reduction in the sliding frictional force in the portion of contact with the fixing film 10 can be achieved and the edges of the recess portions 41 can be prevented from injuring the fixing film.

Also, the recess portions 41 have the effect of holding a lubricant G therein. When as in the prior art, the sliding member 40 is present but the recess portions 41 are absent, if the fixing film 10 is rotated, the lubricant G has been swept out from between the fixing film 10 and the sliding member 40 by a pressing force for forming the fixing nip portion, and has been scarcely left on the surface of the sliding portion corresponding to the fixing nip portion N. However, owing to the presence of the recess portions 41, the lubricant G is held in these recess portions and the lubricant G is held in the fixing nip portion N and therefore, a further reduction in the sliding frictional force between the sliding surfaces of the sliding member 40 and the fixing film 10 corresponding to the fixing nip portion N can be achieved. Accordingly, an increase in torque by durability can be prevented, and it becomes possible to lengthen the life of the apparatus without causing such inconveniences as the loss of synchronism of the driving roller (driving motor) and fixing jam.

In the present embodiment, the recess portions are provided over the full width of the nip in the moving direction of the film and therefore, the lubricant can be held by the full width of the nip and the sliding of the film can be made better. Also, the recess portions overlap one another in the moving direction of the film over the lengthwise direction of the nip orthogonal to the moving direction of the film and therefore, the slidability of the film in the lengthwise direction of the nip can be more uniformized.

The shape of the recess portions 41, the proportion of the total area of the recess portions 41 to the fixing nip portion N, etc. are suitably determined by the passing force and the materials of the fixing film 10, the sliding member 40 and the film guide member 16.

As the confirmation of the effect of the present embodiment, the measurement of the rotation starting torque during room temperature was effected for each 5000 sheets of A4 paper by the use of the fixing apparatus 100 of the present embodiment. The fixing nip portion N was pressed with 20 kgf (≅196 N), and about 7 mm was secured as the width of the nip.

As a comparative example, the rotation starting torque when a sliding member having no recess portion provided in the surface portion corresponding to the fixing nip portion was sued as the sliding member was measured.

In the sliding member provided with no recess portion, the initial rotation starting torque (the torque in the shaft of the pressurizing roller as the driving roller) was 5.0 kgf·cm ($5.0\times9.8\times10^{-2}$=0.49 N·m), but from when 50,000 sheets of paper were supplied, the rate of rise of the rotation starting torque became great, and when 100,000 sheets were exceeded, the rotation starting torque became 7.5 kgf·cm ($7.5\times9.8\times10^{-2}$≅0.74 N·m) or greater, and the loss of synchronism or the like of the driving roller (pressurizing roller) came to occur.

In contrast, when as in the present embodiment, the recess portions 41 were provided in the surface portion of the sliding member 40 corresponding to the fixing nip portion, the initial rotation starting torque was 4.7 kgf·cm (0.46 N·m) lower than in the comparative example, and even at a point of time whereat 50,000 sheets of paper were supplied, 5.2 kgf·cm (0.51 N·m) could be maintained, and also at a point of time whereat 200,000 sheets of paper were supplied, 7.0 kgf·cm (0.69 N·m) or less could be maintained.

While in the present embodiment, the sliding member 40 is provided on the surface portion of the film guide member 16 corresponding to at least the fixing nip portion N, and the recess portions 41 are provided in this sliding member 40, a construction can also be adopted in which the film guide member 16 itself is formed of a material of good heat resistance and slidability and at the same time, the recess portions 41 are integrally formed in the surface portion corresponding to at least the fixing nip portion to thereby provide the surface of the fixing film sliding portion, and again in this case, a similar effect was obtained. That is, in this case, the film guide member is the sliding member as a supporting member.

Another embodiment of the present invention will now be described.

Figure 12A:
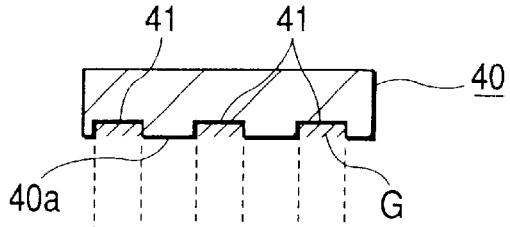
FIGS. 12A and 12B show another sliding member.
Figure 12B:
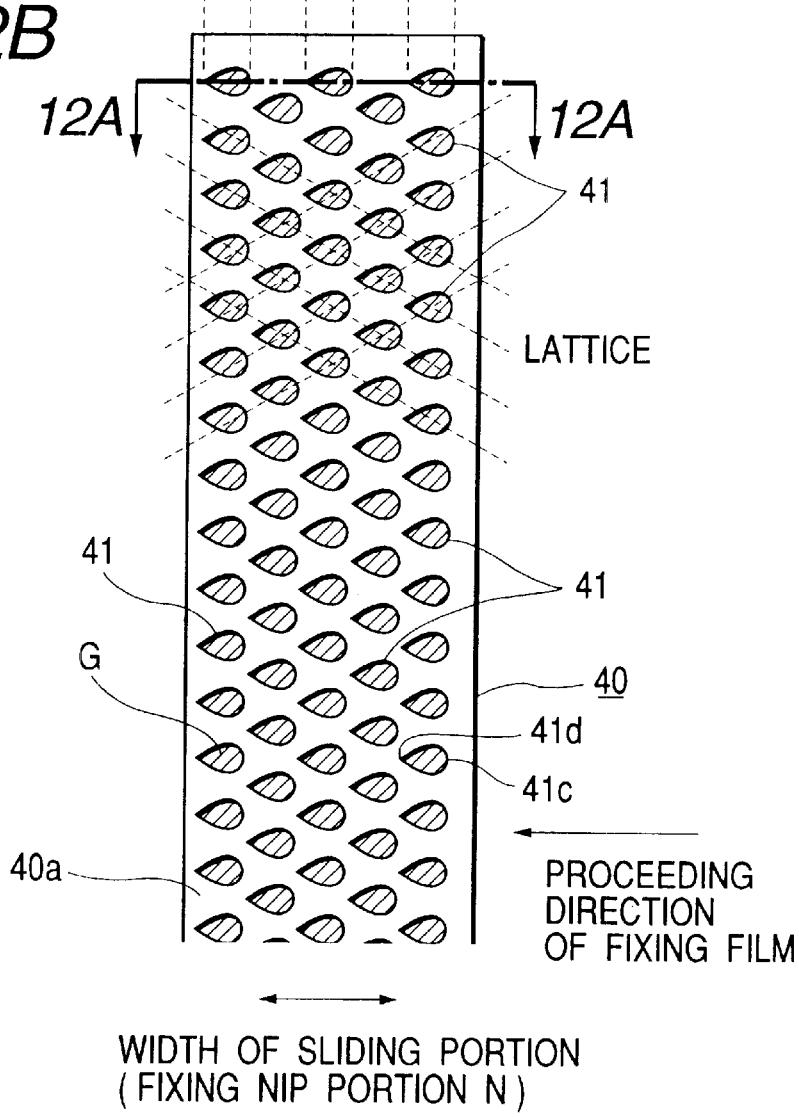

This embodiment is such that the shape of each of the recess portions 41 provided in the surface of the sliding member 40 in the above-described embodiment is a waterdrop shape having an arcuate portion 41*c* and a pointed end portion 41*d*, as shown in FIGS. 12A and 12B, and the arcuate portion 41*c* side of the waterdrop shape is disposed so as to be upstream of the pointed end portion 41*d* side with respect to the direction of progress of the fixing film 10 in the fixing nip portion N.

The waterdrop-shaped recess portions 41 are of a shape in which sliding resistance is smallest with respect to the direction of progress of the fixing film 10 and therefore, the sliding resistance can be made smaller than in the aforedescribed embodiment and thus, the rotational torque at the starting and during steady rotation could be further reduced.

In the other points, the construction of the apparatus is similar to that of the fixing apparatus 100 of the aforedescribed embodiment and therefore need not be described again. Again in the present embodiment, an effect similar to that of the aforedescribed embodiment can be obtained.

Still another embodiment of the present invention will now be described.

Figure 13:
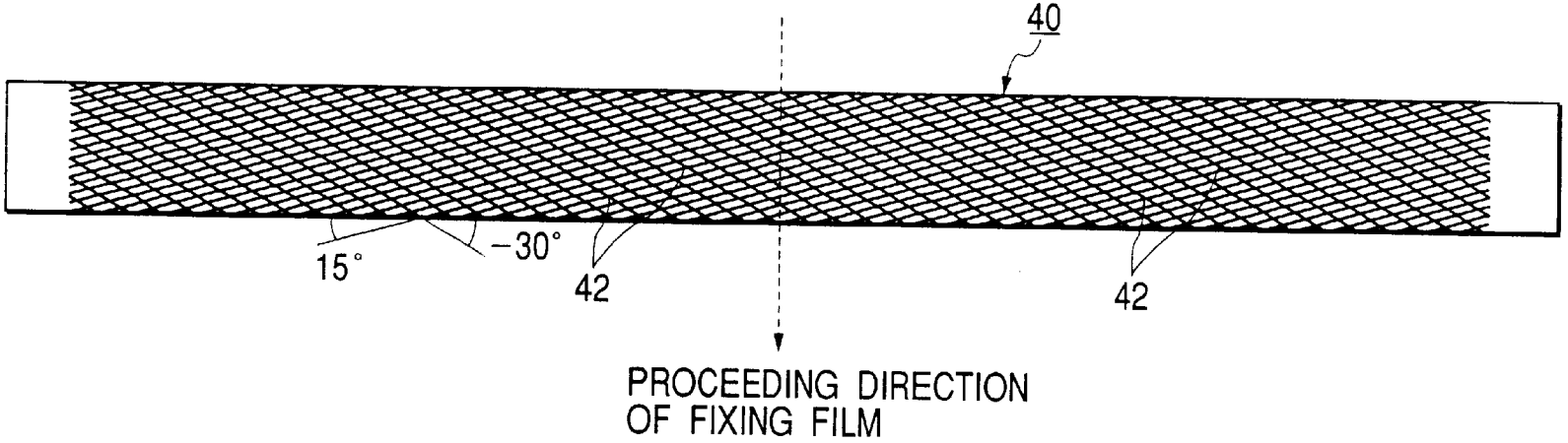
FIG. 13 shows the whole of another sliding member.

This embodiment is one in which as shown in FIG. 13, a plurality of grooves 42 for holding the lubricant therein are formed in the surface of the sliding member 40. It is preferable that the width of each groove 42 be 0.1 to 1.0 mm, the distance between adjacent ones of the grooves be 0.1 to 3.0 mm and the depth of each groove be 0.01 mm or greater. Also, to hold the lubricant between the sliding member 40 and the fixing film 10 in the fixing nip portion N, the direction of the grooves may preferably be less than 45° when the lengthwise direction of the sliding member 40 (a direction orthogonal to the direction of progress of the fixing film) is 0°. If the direction of the grooves becomes 45° or greater, the lubricant holding effect will decrease. Also, the total area of the grooves corresponding to the nip is 20 to 60% of the area of the sliding member corresponding to the nip.

Further, in order to enhance the lubricant holding effect, the grooves 42 are formed in a cross shape as shown in FIG. 13. In the sliding member of FIG. 13, the direction of the grooves 42 is 15° and −30°. Here, preferably the angle of the grooves crossing one another may be changed so that the portions of the grooves which cross one another may not range on a straight line in the moving direction of the fixing film 10. This is because a portion in the fixing nip portion N wherein the portions of the grooves crossing one another range on a straight line becomes smaller in pressurizing area than the other portions and therefore the pressurizing force of that portion may become deficient and cause bad images.

Here, in the aforedescribed embodiments, the recess portions 41 or the grooves 42 in the surface of the sliding member 40 can be formed on the sliding member by cutting, or can be formed by sand blast with the other portions than the recess portions or the other portions than the grooves being masked. Also, during the molding of the sliding member, the recess portions or the grooves can be molded by a mold. It is also possible to form the other portions than the recess portions or the grooves on a heat resisting substrate by screen printing. In this case, a material such as glass is effective.

Yet still another embodiment of the present invention will now be described.

This embodiment is an example of a fixing apparatus of the film heating type using a ceramic heater as a heating member.

Figure 14:
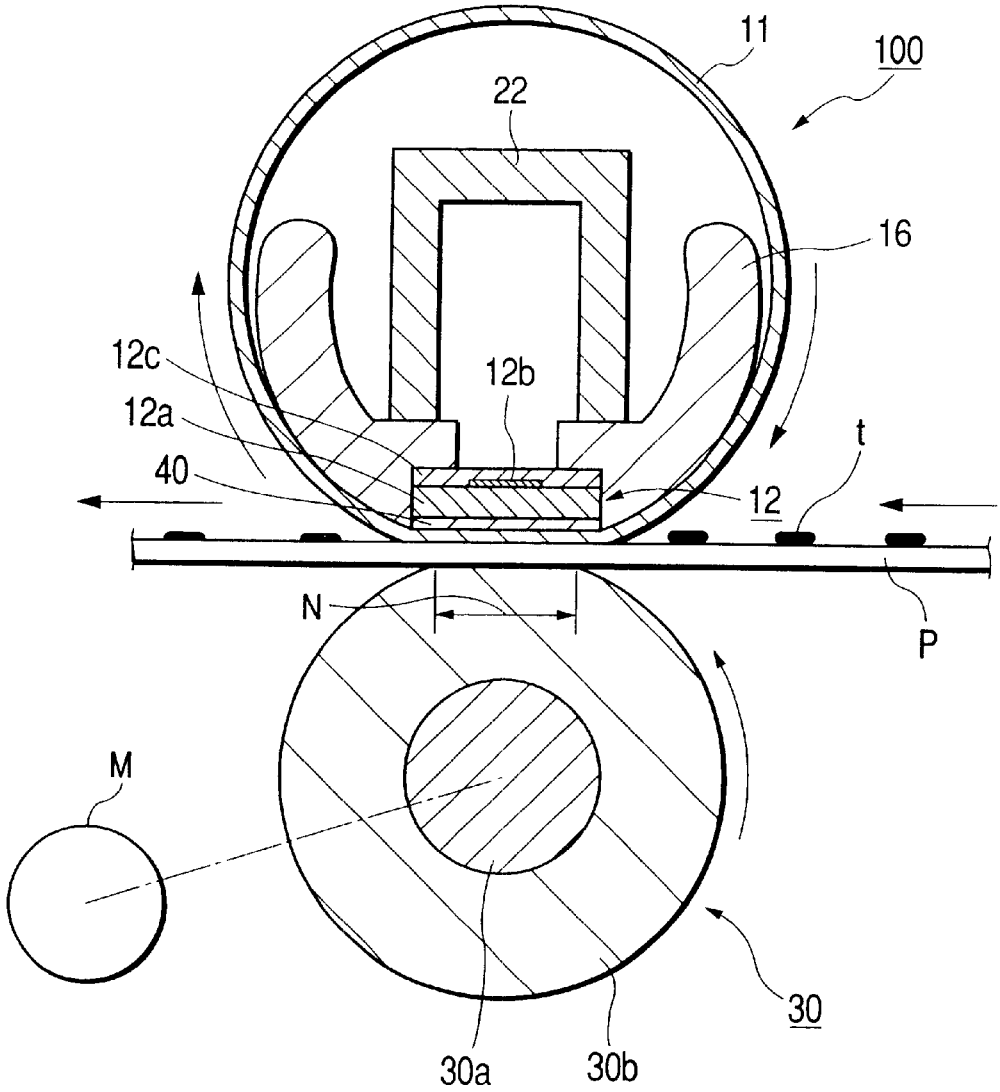
FIG. 14 shows another image heating apparatus.

The fixing apparatus 100 of the present embodiment shown in FIG. 14 broadly comprises a heat-resisting and adiabatic film guide member 16 of a trough shape having a substantially semicircular arcuate cross-section, a ceramic heater 12 as a heating member fitted and fixedly supported in a groove portion formed in the substantially central portion of the lower surface of the film guide member 16 along the length of the guide member, cylindrical or endless heat-resisting fixing film 11 loosely fitted on the film guide member 16 including the ceramic heater 12, and a pressurizing roller 30 as a pressurizing member having a nip portion N formed with the fixing film 11 interposed between itself and the lower surface of the ceramic heater 12 on the film guide member 16 side.

In the present embodiment, the ceramic heater 12 or the film guide member 16 including this ceramic heater 12 is a first member, the fixing film 11 is a second member, and the pressurizing roller 30 is a third member.

The pressurizing roller 30 is an elastic pressurizing roller and has an elastic layer 30*b* of silicone rubber or the like provided on a mandrel 30*a* to thereby reduce the hardness thereof, and is disposed with the opposite end portions of the mandrel 30*a* rotatably held by heatings between this side, not shown, of the apparatus and the chassis side plate on the inner side. In order to improve the surface property of the pressurizing roller 30, a fluorine resin layer of PTFE, PFA, FEP or the like may be further provided on the outer periphery thereof.

The film guide member 16 on which the fixing film 11 is fitted is disposed on the upper side of the pressurizing roller 30 with the ceramic heater 12 side facing downward, and as in the fixing apparatus of the aforedescribed embodiment, pressurizing springs are compressedly provided between the opposite end portions of a pressurizing rigid stay 22 inserted and disposed in the film guide member 16 and spring receiving members on the apparatus chassis side to thereby cause a depressing force to act on the pressurizing rigid stay 22. Thereby, the lower surface of the ceramic heater 12 on the film guide member 16 side and the upper surface of the pressurizing roller 30 are brought into pressure contact with each other with the fixing film 11 interposed therebetween, whereby a fixing nip portion N of a predetermined width is formed.

The pressurizing roller 30 is rotatively driven in a counter-clockwise direction indicated by arrow by driving means M. By this rotative driving of the pressurizing roller 30, a rotating force acts on the fixing film 11 due to the frictional force between the pressurizing roller 30 and the outer surface of the fixing film 11, and the inner peripheral surface of the fixing film 11 comes to rotate around the film guide member 16 in a clockwise direction indicated by arrow at a peripheral speed substantially corresponding to the peripheral speed of the pressurizing roller 30 while sliding in close contact with the lower surface of the ceramic heater 12 in the fixing nip portion N (the pressurizing roller driving type).

In order to reduce the sliding frictional force between the lower surface of the ceramic heater 12 which is the surface of the sliding portion of the fixing film in the fixing nip portion N and the inner surface of the fixing film 11, a sliding member 40 provided with a plurality of independent recess portions 41 or a plurality of grooves 42 which is similar to the sliding member 40 in the fixing apparatus of the aforedescribed embodiments is disposed on the lower surface of the ceramic heater 12. Further, a lubricant such as heat-resisting grease is interposed between the sliding member 40 and the inner surface of the fixing film in the fixing nip portion N.

On the basis of a print starting signal, the rotation of the pressurizing roller 30 is started and the heating-up of the ceramic heater 12 is started. In a state in which the rotational peripheral speed of the fixing film 11 by the rotation of the pressurizing roller 30 has become steady and the temperature of the ceramic heater 12 has risen to a predetermined level, a recording material P as a material to be heated bearing a toner image t thereon is introduced into between the fixing film 11 and he pressurizing roller 30 in the fixing nip portion N with the toner image bearing surface thereof facing the fixing film 11, whereby the recording material P is brought into close contact with the lower surface of the ceramic heater 12 with the fixing film 11 therebetween in the fixing nip portion N and passes through the fixing nip portion N with the fixing film 11. In that passing process, the heat of the ceramic heater 12 is imparted to the recording material P through the fixing film 11 and the toner image t is heated and fixed on the surface of the recording material P. The recording material P having passed through the fixing nip portion N is separated from the surface of the fixing film 11 and is conveyed.

As the fixing film 11, in order to make the heat capacity thereof small and improve the quick starting property, use can be made of film of a single layer of heat resisting PTFE, PFA or FEP having a film thickness of 100 $\mu$m or less, preferably 50 $\mu$m or less and 20 $\mu$m or greater, or a composite layer comprising an outer peripheral surface of polyimide, polyimide amide, PEEK, PES, PPS or the like coated with PTFE, PFA, FEP or the like. In the present embodiment, use is made of polyimide film of a diameter of 25 mm having its outer peripheral surface coated with PTFE.

The ceramic heater 12 as a heating member is a linear heating member of low heat capacity long sideways and having as its lengthwise direction a direction orthogonal to the moving direction of the fixing film 11 and the recording material P. The ceramic heater in the present embodiment basically comprises a heater substrate 12*a* formed of aluminum nitride (AlN) or the like, a heat generating layer 12*b* provided on the surface of this heater substrate 12*a* along the length thereof, e.g. a heat generating layer 12*b* comprising an electrical resistance material such as Ag/Pd (silver/palladium) provided to a thickness of about 10 $\mu$m and a width of 1 to 5 mm by screen printing or the like, and a protective layer 12*c* of glass, fluorine resin or the like further provided thereon. The sliding member 40 is provided on the heater substrate back side opposite to the surface of the heater substrate 12*a* of this ceramic heater 12 on which the heat generating layer 12*b* and the protective layer 12*c* are provided.

Electric power is supplied across the heat generating layer 12*b* of the ceramic heater 12, whereby the heat generating layer 12*b* generates heat and the heater 12 rapidly rises in temperature. The temperature of the heater is detected by a temperature sensor, not shown, and the supply of electric power to the heat generating layer 12*b* is controlled by a control circuit, not shown, and the heater 12 is temperature-controlled so that the temperature of the heater may be maintained at a predetermined temperature.

The ceramic heater 12 is fitted and fixedly supported in a groove portion formed in the substantially central portion of the lower surface of the film guide member 16 along the length of the guide with its protective layer 12*c* side facing upward.

Again in a heating form different from the aforedescribed embodiments like the apparatus of the present embodiment, the reduction in torque at the start of rotation and during steady rotation could be achieved.

If the heater substrate 12*a* itself of the ceramic heater 12 is of a material good in the slidability relative to the fixing film 11, the surface of the heater substrate 12*a* can be directly used as the surface of the sliding portion relative to the fixing film without a separate sliding member 40 being provided, and that surface can also be provided with recess portions 41 or grooves 42. In this case, the substrate 12*a* is the sliding member.

In the apparatus of the present embodiment, there can also be adopted a construction in which the ceramic heater 12 as a heating member is changed to an electromagnetic induction heat-generative member such as an iron plate and an excitation coil and a magnetic core as magnetic field producing means are disposed inside the film guide member 16 and electromagnetic induction heat generation is effected with the electromagnetic induction heat-generative member such as an iron plate as a heating member, whereby the generated heat is imparted to the recording material P through the fixing film 11 in the fixing nip portion N.

Again in this case, a sliding member 40 provided with a plurality of independent recess portions 41 or grooves 42 is disposed on the surface of the sliding portion of the electromagnetic induction heat-generative member as a heating member relative to the fixing film. Also, if the electromagnetic induction heat-generative member itself as a heating member is of a material good in slidability relative to the fixing film 11, the surface of the electromagnetic induction heat-generative member as a heating member can be directly used as the surface of the sliding portion relative to the fixing film without a separate sliding member 40 being provided and that surface can also be provided with recess portions 41 or grooves 42.

Again in the present embodiment, an effect similar to that of the aforedescribed embodiments can be obtained.

The apparatus construction of the fixing apparatus as a heating apparatus is not restricted to the pressurizing roller driving type of the aforedescribed embodiments.

Figure 15:
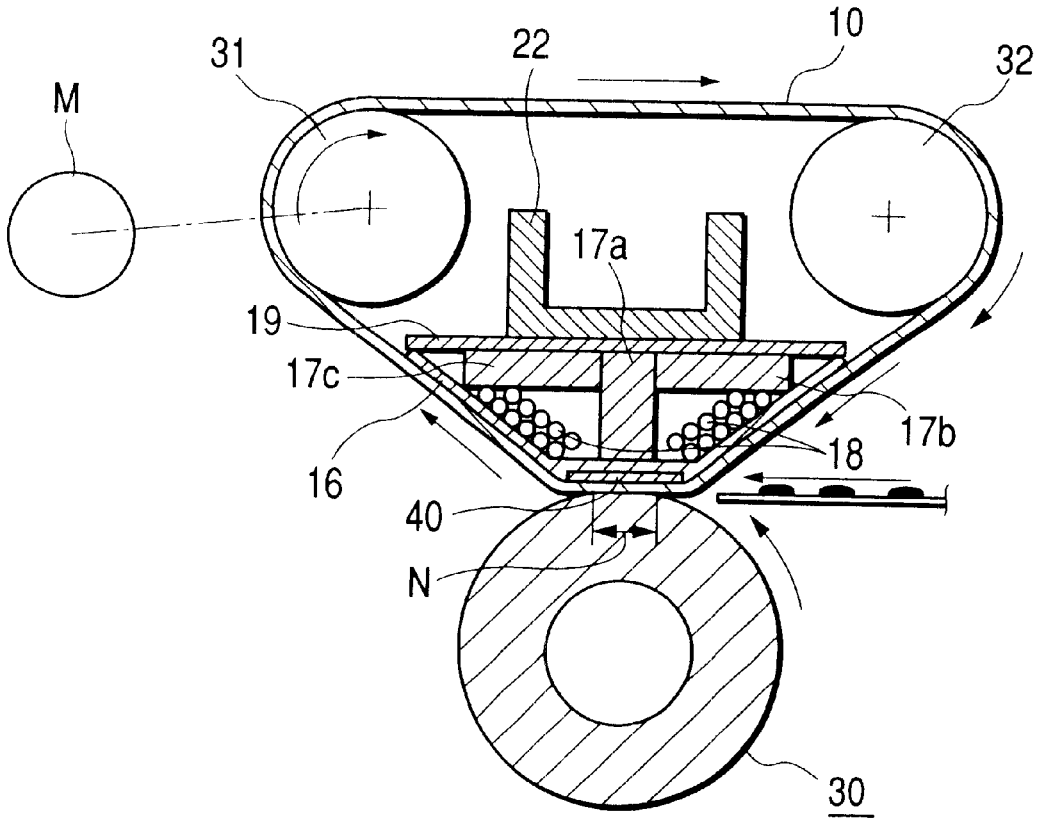
FIG. 15 shows another image heating apparatus.

For example, there can also be adopted an apparatus construction as shown in FIG. 15 wherein electromagnetic induction heat-generative endless film-shaped fixing film 10 is wound and passed over a film guide member 16, a driving roller 31 and a tension roller 32, the lower surface portion of the film guide member 16 and a pressurizing roller 30 as a pressurizing member are brought into pressure contact with each other with the fixing film 10 interposed therebetween to thereby form a fixing nip portion N, and the fixing film 10 is rotatively driven by the driving roller 31. In this case, the pressurizing roller 30 is a driven roller.

Magnetic cores 17*a,* 17*b,* 17*c* and an excitation coil 18 as magnetic field producing means are provided inside the film guide member 16.

A sliding member 40 is disposed on the lower surface portion of the film guide member 16 corresponding to the fixing nip portion N to reduce the mutual sliding frictional force relative to the inner surface of the fixing film 10. The surface of the sliding portion of this sliding member 40 relative to the inner surface of the fixing film, like the sliding member 40 in the fixing apparatus of the aforedescribed embodiment, is provided with a plurality of independent recess portions 41. Further, a lubricant G such as heat-resisting grease is interposed between the sliding member 40 and the inner surface of the fixing film in the fixing nip portion N.

Again in the apparatus of this driving type, an effect similar to that of the aforedescribed embodiments can be obtained.

The plane shape of the recess portions 41 provided in the surface of the sliding member 40 or the surface of the sliding portion can be any shape, besides the circular shape and the waterdrop shape in the embodiments. The plane shape of the grooves 42 is neither limited to a straight line, but can be a saw-tooth shape or a waveform.

Also, the electromagnetic induction heat-generative fixing film 10 can also assume a form in which the elastic layer 2 is omitted, in the case of the use for heating and fixing monochromatic or 1-pass multicolor images. The heat generating layer 1 can also be formed of a metal filler mixed with resin. A member having a single heat generating layer can also be adopted.

Also, there can be adopted an apparatus construction of a form in which the fixing film 10 or 11 is not an endless rotary member, but is a rolled long web member having ends which is adapted to be said away and moved.

The pressurizing member 30 is not limited to a roller body, but may also be a member of other form such as a rotary belt type.

There can also be adopted an apparatus construction in which in order to supply heat energy to the recording material also from the pressurizing member 30 side, heating means such as electromagnetic induction heating is also provided on the pressurizing member 30 side and the recording material is heated and controlled to a predetermined temperature.

The heating apparatus of the present invention can be widely used not only as the image heating and fixing apparatuses of the described embodiments, but also as an image heating apparatus for heating a recording material heating an image thereon and changing the surface property thereof such as luster, an image heating apparatus for tentatively fixing an image, and means or apparatuses for heating and processing a material to be heated such as a heating and drying apparatus for a material to be heated and a heating laminate apparatus.

As described above, according to the present invention, for example, like a heating apparatus of the film heating type or the like, in a heating apparatus which has a first member, a second member slidably moved relative to the first member, and a third member abutting against the first member with the second member interposed therebetween, and in which a material to be heated is held and conveyed by a contact portion formed by the abutting of the third member against the second member and the material to be heated is pressurized and heated, and an image forming apparatus provided with this heating apparatus as an image heating and fixing apparatus, a plurality of independent recess portions or a plurality of grooves are provided in the sliding portion of the first member relative to the second member which corresponds to the contact portion formed by the abutting of the third member against the second member, whereby the area of contact in the sliding portion of the first member relative to the second member becomes small and sliding frictional resistance is reduced and further, the increase in the sliding frictional resistance by the sheet passing duration test to paper supply can be suppressed and the longer life of the apparatus can be achieved.

Consequently, the slip of the material to be heated can be prevented and therefore, the stable conveyance of the material to be heated can be secured, and in the image heating and fixing apparatus, it becomes possible to secure images of high dignity and the stable conveyance of recording materials.

Further, a motor of smaller driving torque can be used as the driving motor of the heating apparatus, and this leads to a reduction in the cost of product.

Also, the lubricant interposed between the first member and the second member in the nip portion is held in the plurality of independent recess portions or the plurality of grooves provided in the sliding portion of the first member relative to the second member in the nip portion and therefore, the occurrence of the situation in which the lubricant is swept out from between the first member and the second member in the nip portion and is scarcely left is prevented, and it becomes possible to maintain the effect of reducing the sliding frictional resistance between the first member and the second member by the lubricant for a long period of time.

While the embodiments of the present invention have been described above, the present invention is not restricted to the above-described embodiments, but all modifications are possible within the technical idea of the present invention.

What is claimed is:

1. An image forming apparatus comprising:

a supporting member;

a moving member slidable with said supporting member; and a backup member forming a nip with said supporting member via said moving member;

wherein a lubricant is provided between said supporting member and said moving member, and at said nip, an image on a recording material is heated by heat from said moving member, and wherein a surface on a side of the nip of said supporting member includes a plurality of dimples, a width of one of said plurality of dimples in a moving direction of said moving member is smaller than a width of said nip in that direction, and said plurality of dimples are arranged in the moving direction of said moving member, and range over the whole of said nip in the moving direction of said moving member.

2. An image heating apparatus according to claim 1, wherein a total area of said dimples corresponding to said nip is 20 to 60% of an area of said supporting member corresponding to said nip.

3. An image heating apparatus according to claim 1, wherein a width of each of said plurality of dimples along the moving direction of said moving member is 0.1 to 3 mm, and a depth thereof is 0.01 mm or greater.

4. An image heating apparatus according to claim 1, wherein each of said plurality of dimples is circular.

5. An image heating apparatus according to claim 1, wherein each of said plurality of dimples is of a waterdrop shape having an arcuate portion and a pointed end portion.

6. An image heating apparatus according to claim 5, wherein the arcuate portion of each of said plurality of dimples is provided at a upstream side of the pointed end portion with respect to the moving direction of said moving member.

7. An image heating apparatus according to claim 1, wherein said supporting member is a sliding member.

8. An image heating apparatus according to claim 1, further comprising magnetic flux producing means for producing a magnetic flux, wherein an eddy current is created in said moving member by the magnetic flux produced by said magnetic flux producing means, and said moving member generated heat by said eddy current.

9. An image heating apparatus according to claim 1, wherein said supporting member is a heater, and the image is heated by the heat from said heater passed through said moving member.

10. An image heating apparatus according to claim 1, wherein said moving member is a film.

11. An image heating apparatus according to claim 1, wherein said backup member is a roller.

12. An image heating apparatus comprising:

a supporting member;

a moving member slidable with said supporting member; and a backup member forming a nip for nipping and conveying a recording material with said supporting member via said moving member;

wherein a lubricant is provided between said supporting member and said moving member, and at said nip, an image on the recording material is heated by heat from said moving member, and wherein a plurality of dimples are distributed on a surface on the side of the nip of said supporting member, and any point on the recording material passes through said dimples.

13. An image heating apparatus according to claim 12, wherein a total area of said dimples corresponding to said nip is 20 to 60% of an area of said supporting member corresponding to said nip.

14. An image heating apparatus according to claim 12, wherein a width of each of said plurality of dimples along the moving direction of said moving member is 0.1 to 3 mm, and a depth thereof is 0.01 mm or greater.

15. An image heating apparatus according to claim 12, wherein each of said plurality of dimples is circular.

16. An image heating apparatus according to claim 12, wherein each of said dimples is of a waterdrop shape having an arcuate portion and a pointed end portion.

17. An image heating apparatus according to claim 16, wherein the arcuate portion of each of said dimples is provided at a upstream side of the pointed end portion with respect to the moving direction of said moving member.

18. An image heating apparatus according to claim 12, wherein said supporting member is a sliding member.

19. An image heating apparatus according to claim 12, further comprising magnetic flux producing means for producing a magnetic flux, wherein an eddy current is created in said moving member by the magnetic flux produced by said magnetic flux producing means, and said moving member generates heat by said eddy current.

20. An image heating apparatus according to claim 12, wherein said supporting member is a heater, and the image is heated by the heat from said heater passed through said moving member.

21. An image heating apparatus according to claim 12, wherein said moving member is film.

22. An image heating apparatus according to claim 12, wherein said backup member is a roller.

23. An image heating apparatus comprising:

a supporting member; and a moving member slidable with said supporting member;

wherein a lubricant is provided between said supporting member and said moving member, and an image on a recording material is heated by the heat from said moving member, and wherein said supporting member includes a groove in a surface thereof adjacent to said moving member, and an angle of said groove with respect to a direction orthogonal to the moving direction of said moving member is less than 45°.

24. An image heating apparatus according to claim 23, wherein said groove is a plurality, and a width of said groove is 0.1 to 1 mm, a spacing between said grooves is 0.1 to 3 mm, and a depth of said groove is 0.01 mm or greater.

25. An image heating apparatus according to claim 23, wherein said supporting member is a sliding member.

26. An image heating apparatus according to claim 23, further comprising magnetic flux producing means for producing a magnetic flux, wherein an eddy current is created in said moving member by the magnetic flux produced by said magnetic flux producing means, and said moving member generates heat by said eddy current.

27. An image heating apparatus according to claim 23, wherein said supporting member is a heater, and the image is heated by the heat from said heater passed through said moving member.

28. An image heating apparatus according to claim 23, wherein said moving member is film.

29. An image heating apparatus according to claim 23, further comprising a backup member forming a nip with said supporting member via said moving member.

30. An image forming apparatus according to claim 29, wherein said backup member is a roller.

31. An image heating apparatus according to claim 29, wherein a total area of said groove corresponding to said nip is 20 to 60% of an area of said supporting member corresponding to said nip.

32. An image heating apparatus comprising:

a supporting member; and a moving member slidable with said supporting member;

wherein a lubricant is provided between said supporting member and said moving member, and an image on a recording material is heated by heat from said moving member, and wherein said supporting member includes a first groove and a second groove in a surface thereof adjacent to said moving member, and said first groove and said second groove intersect with each other.

33. An image heating apparatus according to claim 32, wherein a smaller angle of said first groove with respect to a direction orthogonal to the moving direction of said moving member and a smaller angle of said second groove with respect to that direction differ from each other.

34. An image heating apparatus according to claim 32, wherein widths of said first and second grooves are 0.1 to 1 mm, depths of said first and second grooves are 0.01 mm or greater, said first and second grooves have plural grooves, and spacings between the grooves are 0.1 to 3 mm.

35. An image heating apparatus according to claim 32, wherein said supporting member is a sliding member.

36. An image heating apparatus according to claim 32, further comprising magnetic flux producing means for producing a magnetic flux, wherein an eddy current is created in said moving member by the magnetic flux produced by said magnetic flux producing means, and said moving member generates heat by said eddy current.

37. An image heating apparatus according to claim 32, wherein said supporting member is a heater, and the image is heated by the heat from said heater passed through said moving member.

38. An image heating apparatus according to claim 32, wherein said moving member is film.

39. An image heating apparatus according to claim 32, further comprising a backup member forming a nip with said supporting member via said moving member.

40. An image heating apparatus according to claim 39, wherein said backup member is a roller.

41. An image heating apparatus according to claim 39, wherein a total area of said grooves corresponding to said nip is 20 to 60% of an area of said supporting member corresponding to said nip.

* * * * *

UNITED STATES PATENT AND TRADEMARK OFFICE

CERTIFICATE OF CORRECTION

PATENT NO. : 6,456,819 B1
DATED : September 24, 2002
INVENTOR(S) : Atsuyoshi Abe et al.

It is certified that error appears in the above-identified patent and that said Letters Patent is hereby corrected as shown below:

Title page, Item [54] and Column 1, line 1,
"IMAGE HEATING APPARATUS" should read -- BELT-TYPE IMAGE HEATING APPARATUS WITH SUPPORT FOR SUPPORTING BELT --.

Column 11,
Line 56, "with" should read -- width --.

Column 19,
Line 39, "a" should read -- an --.

Column 20,
Line 22, "a" should read -- an --.

Signed and Sealed this

Eleventh Day of March, 2003

JAMES E. ROGAN
*Director of the United States Patent and Trademark Office*